US005907886A

United States Patent [19]

Buscher

[11] Patent Number: 5,907,886

[45] Date of Patent: Jun. 1, 1999

[54] DETECTOR DEVICE FOR FILTER BAGS FOR VACUUM CLEANERS

[75] Inventor: Thomas Buscher, Dietenhofen, Germany

[73] Assignee: Branofilter GmbH, Dietenhofen, Germany

[21] Appl. No.: 08/789,290

[22] Filed: Jan. 28, 1997

[30] Foreign Application Priority Data

Feb. 16, 1996 [DE] Germany ..... 196 05 780

[51] Int. Cl.[6] ..... A47L 9/28

[52] U.S. Cl. ..... 15/319; 15/339; 55/385.6; 55/378; 55/DIG. 2; 96/423

[58] Field of Search ..... 15/319, 339; 55/385.6; 96/423

[56] References Cited

U.S. PATENT DOCUMENTS

| | | | |
|---|---|---|---|
| 2,839,156 | 6/1958 | Martinec . | |
| 2,860,725 | 11/1958 | Cawl et al. | 55/214 X |
| 4,001,912 | 1/1977 | Eriksson | 15/339 |
| 4,184,225 | 1/1980 | Leinfelt . | |
| 4,245,370 | 1/1981 | Baker . | |
| 4,766,639 | 8/1988 | Lindquist et al. | 15/339 |

FOREIGN PATENT DOCUMENTS

| | | |
|---|---|---|
| 26 03 110 | 8/1976 | Germany . |
| 26 55 547 | 6/1978 | Germany . |
| 34 34 209 | 3/1986 | Germany . |
| 41 10 683 | 10/1992 | Germany . |
| 43 39 297 | 9/1994 | Germany . |
| 43 39 298 | 9/1994 | Germany . |
| 1-313032 | 2/1990 | Japan . |
| 2-131732 | 8/1990 | Japan . |
| 5-184497 | 11/1993 | Japan . |
| 1 440 174 | 6/1976 | United Kingdom . |

*Primary Examiner*—Chris K. Moore
*Attorney, Agent, or Firm*—Flynn, Thiel, Boutell & Tanis, P.C.

[57] ABSTRACT

A detector device for filter bags in vacuum cleaners which comprises a sensor device adapted to sense a tabular or plate-like connection member of such vacuum cleaner filter bag and switching means controlled by the sensor device for preventing switching-on of the motor of the vacuum cleaner if the connection member is not properly detected. The electronic sensor device is adapted to sense at least one detectable element in or on the connection member by electromagnetic waves and is connected with the switching means by a processing device for checking the correct position and correct type of the at least one detectable element. This means that it is not only possible to check for the presence of a filter bag in the vacuum cleaner but furthermore to discriminate whether same is correctly fitted and is of the right type for the said vacuum cleaner so that impairment of and damage to the vacuum cleaner by mounting the wrong type of filter bag is prevented.

34 Claims, 3 Drawing Sheets

DETECTOR DEVICE FOR FILTER BAGS FOR VACUUM CLEANERS

BACKGROUND OF THE INVENTION

The invention relates to a detector device for filter bags in vacuum cleaners comprising a sensor device adapted to sense a tabular or plate-like connection member of a vacuum cleaner filter bag and switching means controlled by the sensor device for preventing switching-on of the motor of the vacuum cleaner if the connection member is not properly detected.

THE PRIOR ART

The German patent 2,603,110, the German patent 3,434,209 and the U.S. Pat. No. 2,839,156 respectively disclose such a detector device, in which the connection member of a filter bag mounted in the vacuum cleaner operates a switch so that in this manner the presence of the vacuum cleaner bag can be ascertained. It is only when the switch is actuated that the vacuum cleaner motor can be turned on. Furthermore the German patent 2,655,547, the British patent 1,440,174 and the U.S. Pat. No. 4,184,225 disclose pneumatic arrangements with which the presence of a vacuum cleaner bag may be detected pneumatically and in the case of which it is solely following the detection of the vacuum cleaner bag that switching on of the vacuum cleaner motor is possible.

While the known detector devices do render it possible to prevent switching on of the motor when no filter bag is mounted there is however still the danger of the wrong type of filter bag being mounted, which may also lead to faulty operation.

SHORT SUMMARY OF THE INVENTION

One object of the invention is consequently to create a detector device of the type initially mentioned by means of which there is not only a prevention of switching on of the vacuum cleaner in the absence of a filter bag but also of switching on if the filter bag is improperly mounted or is of the wrong type.

A further object of the invention is to discriminate against filter bags of an inappropriate type.

In order to achieve these and/or other objects of the invention, the present invention the sensor device is arranged to sense at least one detectable element in or on the connection member or filter bag by electromagnetic waves and is connected with the switching means by a processing device for checking the correct position and correct type of the at least one detectable element.

Owing to the detector device of the invention it is possible for any attempt at switching on of the vacuum cleaner with the wrong filter bag to be reliably thwarted, even if a filter bag of the wrong type is mounted which has a connection member, whose configuration is the same as that of a correct type of filter bag. If for example a filter bag of a poorer quality is mounted, which by chance possesses the same geometry of design, the result might be that there would be an excessive amount of dust passing through the wall of a micro-filter arranged downstream with the result that the function of the vacuum cleaner would be generally become less satisfactory, there also then being even the possibility of damage to the vacuum cleaner motor. A further point is that with the wrong type of filter bag—which is insufficiently porous and leads to insufficient flow—there may be impairment of the function of the vacuum cleaner or indeed even damage to the vacuum cleaner motor. The detector device of the invention renders it possible to reliably check that the correct type of filter bag is mounted in the vacuum cleaner so that the function of the vacuum cleaner remains optimum and damage due to filter bags with excessively fine or excessively coarse pores can be precluded. In addition the detector device means that an incorrectly inserted filter bag or indeed the absence of the same may be recognized. Furthermore, as regards the every increasing stringency of product liability requirements, the detector device in accordance with the invention has been found to be highly advantageous.

The design at least of the sensor device and the processing device and preferably also of the switching means as a single subassembly on one printed circuit board and/or the design thereof as an integrated circuit means that it is possible for the detector device of the invention to be manufactured without changes in the mechanical design of vacuum cleaners being required to depart from conventional ones or from conventional vacuum cleaner housings. Such subassembly may be arranged in a simple and inexpensive manner in or on the wall of the vacuum cleaner housing adjacent to the connection member, or a portion having the detectable element of the filter bag, it being preferred for the wall, provided with the subassembly, of the vacuum cleaner housing to be arranged essentially parallel to and directly adjacent to the mounted or inserted connection member.

For the production of the electromagnetic waves the sensor device may advantageously possess at least one transmitter more especially having an oscillating circuit, the sensor signals being derived from the reaction of the detectable element to the transmitter and/or the electromagnetic waves. It is in this manner that the sensor device may respond extremely sensitively to the configuration and design of the detectable element so that the connection member, having the detectable element, of the respective filter bag can be reliably recognized.

In accordance with a first, extremely advantageous embodiment of the invention the detectable element is designed in the form of a metallic sheet element, more particularly in the form of a metal plate, foil or layer and the sensor signals are produced in a fashion dependent on the damping caused by the eddy current effect, of the transmitter. The mounting of such a metallic sheet element on or in the connection member may then be carried out in an extremely inexpensive fashion, variations in the respective area and in the respective geometry being possible in a simple way.

For processing, the detectable element in the processing device is preferably assigned a predetermined amplitude of oscillation of the oscillating circuit, a threshold value section being provided in the processing device for detection, such section being supplied with a signal derived from the amplitude of oscillation of the oscillating circuit, switching on of the vacuum cleaner motor being stopped above an adjustable first threshold value. As from a certain area of the detectable element, that is to say as from a predetermined degree of attenuation, the switch on stop means is overridden.

Even more reliable detection of the correct type of filter bag is achieved if value switching on of the vacuum cleaner is stopped additionally below a second adjustable lower threshold value switching. This means for example that no incorrect type of vacuum cleaner bag, whose connection member is for example covered with metal foil or comprises metallic components, will be detected as being the correct type of filter bag.

In another advantageous design the detectable element comprises means for transmitting back signals representing a modified form of the received electromagnetic waves, the sensor device possessing a corresponding receiving device. The result is an even greater reliability of detection. The modified signals may be changed as regards their frequency and/or phase angle or they may comprise a signal code. In the processing device suitable recognizing or detection means are comprised for the retransmitted signals which have been modified in a predetermined manner.

Such a detectable element, which calls for a technically sophisticated design, is preferably designed in the form of a micro-chip, which may for example be arranged between different layers in the connection member and may be mass manufactured relatively cheaply.

In accordance with a further alternative design it is possible for the transmitter to be in the form of an optical transmitter and for the detectable element to be in the form of an element retransmitting the light back to an optical receiver. As a detectable element a bar-code is suitable in this case or a deflecting means may be employed adapted to return the light with or without modification to a predetermined position in the sensor device.

As a further advantageous design it is also possible to provide for capacitive detection of the detectable element.

In order to ensure very reliable detection of a correct connection member or, respectively, filter bag in the case of very simple detectable elements (for example metallic sheet elements), a plurality of detectable elements may be arranged on or in the connection member and/or the filter bag and may be sensed by a corresponding number of sensor parts of the sensor device.

Further advantageous developments and convenient forms of the invention will be readily comprehended from the following detailed descriptive disclosure of one embodiment thereof in conjunction with the accompanying drawings.

LIST OF THE SEVERAL VIEWS OF THE FIGURES.

DETAILED ACCOUNT OF WORKING EMBODIMENTS OF THE INVENTION.

Figure 1:
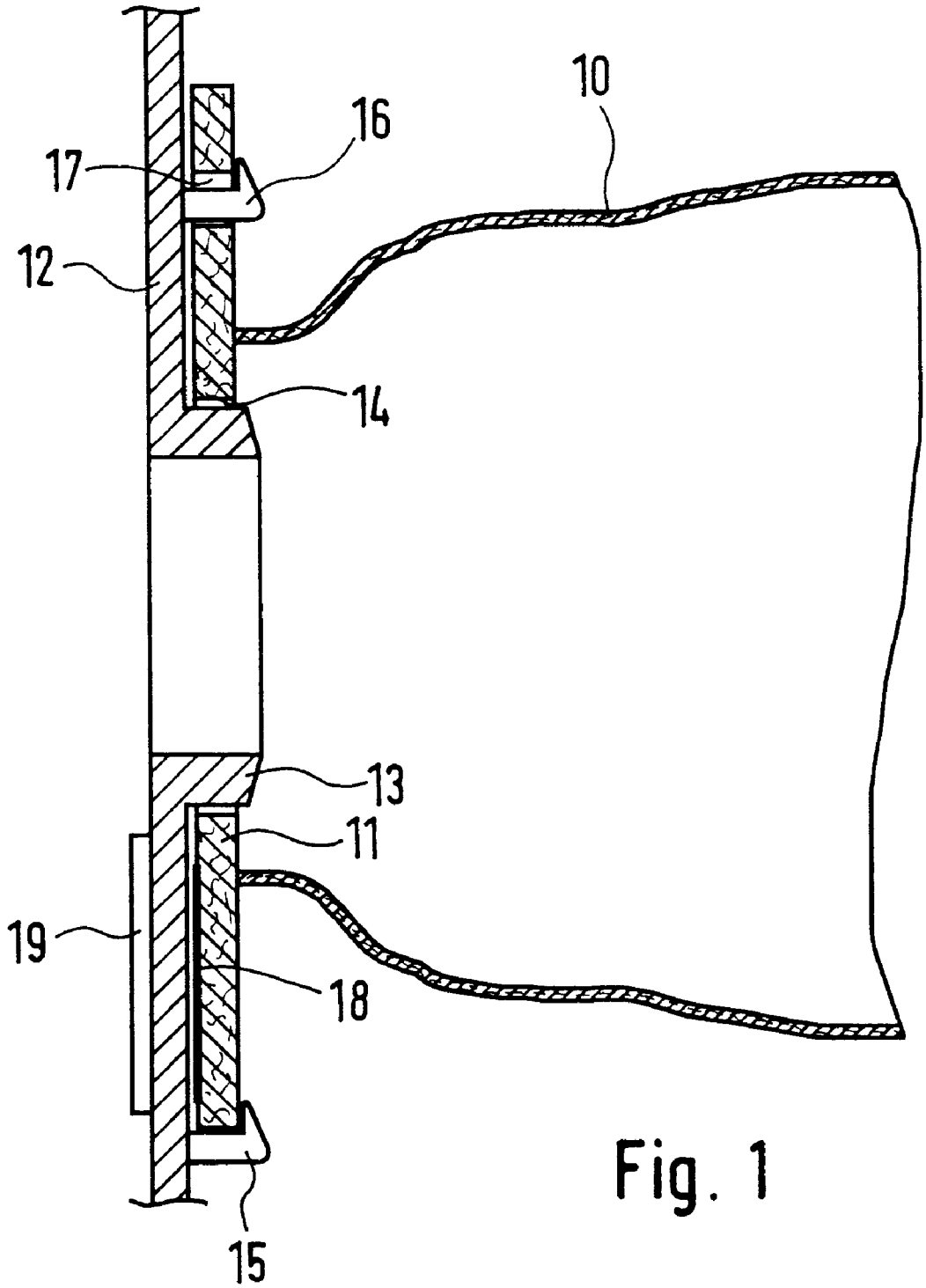
FIG. 1 is a simplified sectional view of a filter bag mounted on part of the housing of a vacuum cleaner vacuum cleaner motor.
Figure 5:
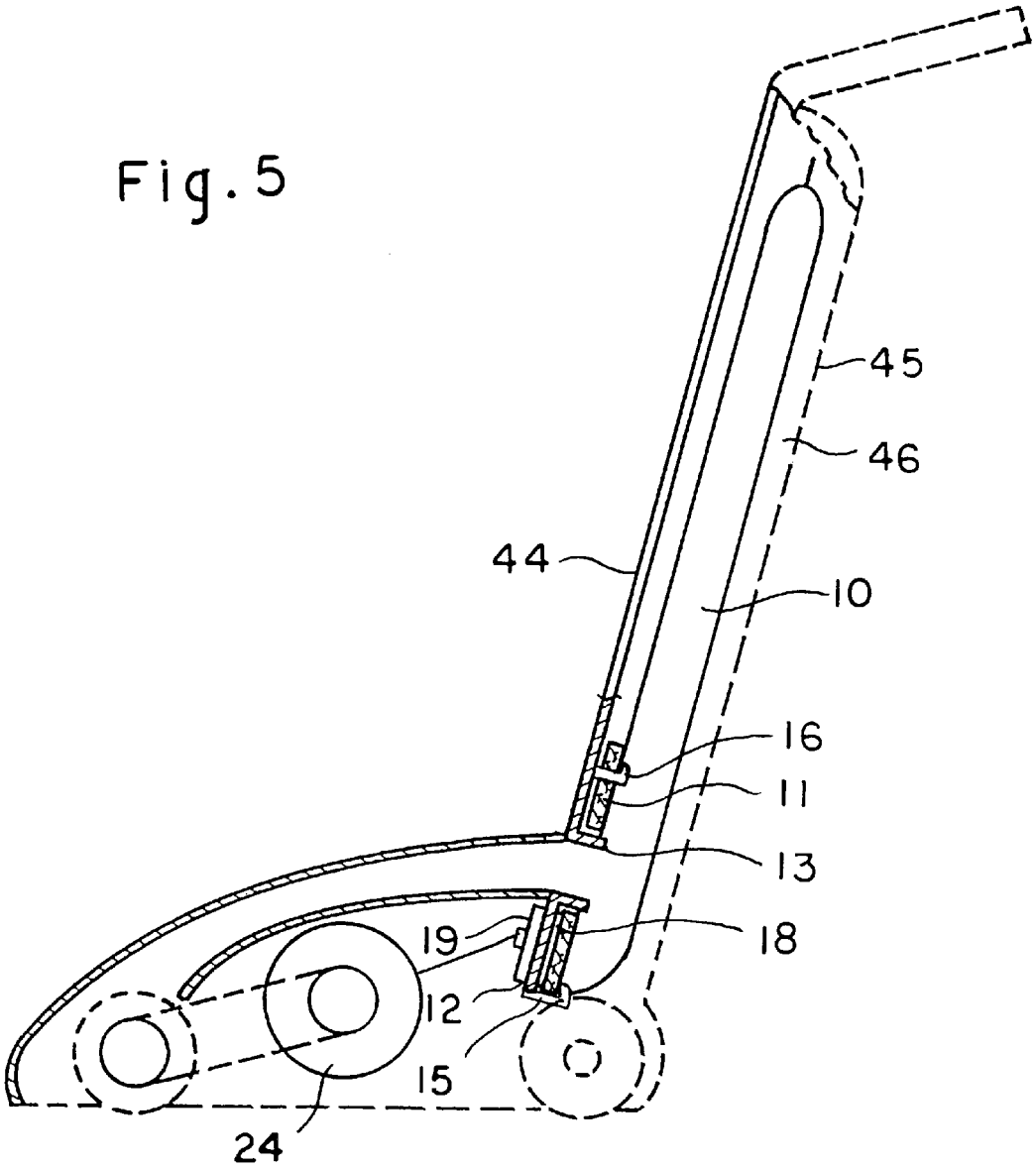
FIG. 5 is a diagrammatic representation of how the bag detector of this invention is incorporated into a vacuum cleaner.

The filter bag diagrammatically represented in FIGS. 1 and 5 comprises the filter bag 10 proper, whose wall is manufactured of a material able to allow the passage of air therethrough while retaining dust, and a connection member 11, which is attached, preferably by bonding, to a part having the entry opening of the filter bag 10 as such in it.

Vacuum cleaner 44 includes a housing 46 with a receiving space 45 for filter bag 10. A wall 12, which is illustrated in part, of the vacuum cleaner for which the filter bag is designed, a connection spout 13, projects into the receiving space 45 for the filter bag, is present. Connection member 11 is slipped when the filter bag is introduced into the vacuum cleaner so that the connection spout 13 fits through receiving opening 14 formed in the connection member 11 and extends into the interior of the filter bag. It is in this manner that the air drawn in by the vacuum cleaner 44 may make its way into the filter bag 10 wherein the dust borne therein may be then be retained as filtered dust on the inner wall surface of the bag.

The connection member 11 is essentially tabular in design and consists of board-like, stiff material. A slide closure, as is generally provided, and a diaphragm seal normally surrounding the receiving opening 14, are not illustrated for simplification of the drawings and in any case same are not present on all conventional filter bags. If a closure slide is present the connection member 11 will conventionally comprise a plurality of plies of board as is for example described and illustrated in the German patent 4,339,298.

For the attachment of the connection member 11 to the wall 12 the latter possesses a holding rail 15 provided with a receiving groove for one marginal portion of the connection member 11, it also being possible for such rail 15 to be replaced by two correspondingly shaped holding elements. On the opposite side a catch projection 16 extends through a catch opening 17 when the connection member 11 is placed on the spout 13 and locks the connection member 11 in place. For this purpose it is possible for example to provide two catch projections 16 and two catch openings 17. Moreover the type of attachment is without importance for the present invention and may for example be designed according to the prior art noted supra or in accordance with the German patent 4,339,297.

Figure 2:
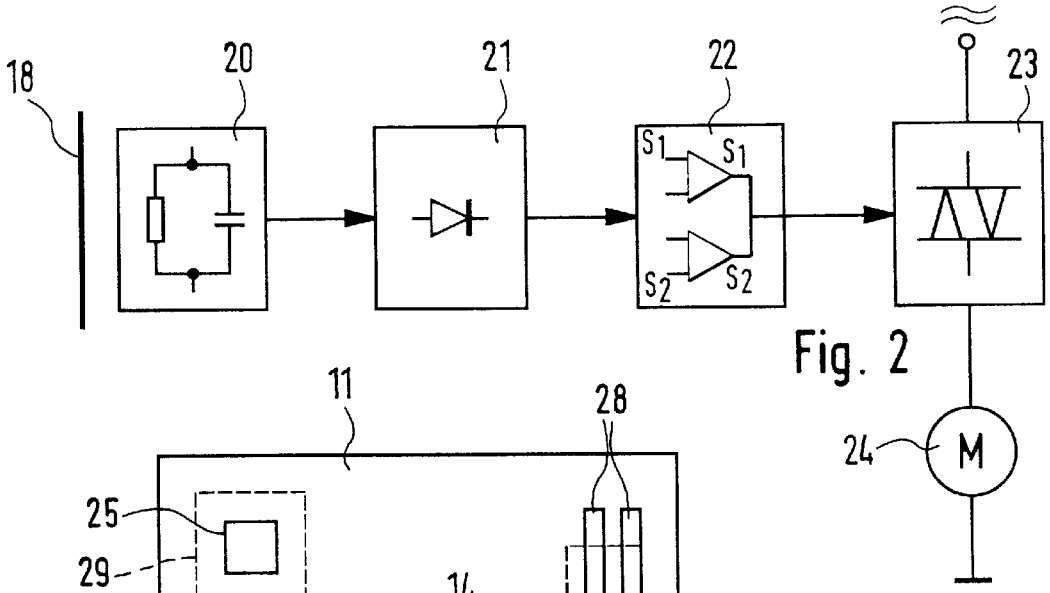
FIG. 2 is a block circuit diagram of a first embodiment of the invention having a detectable element in the form of a metallic sheet element.
Figure 4:
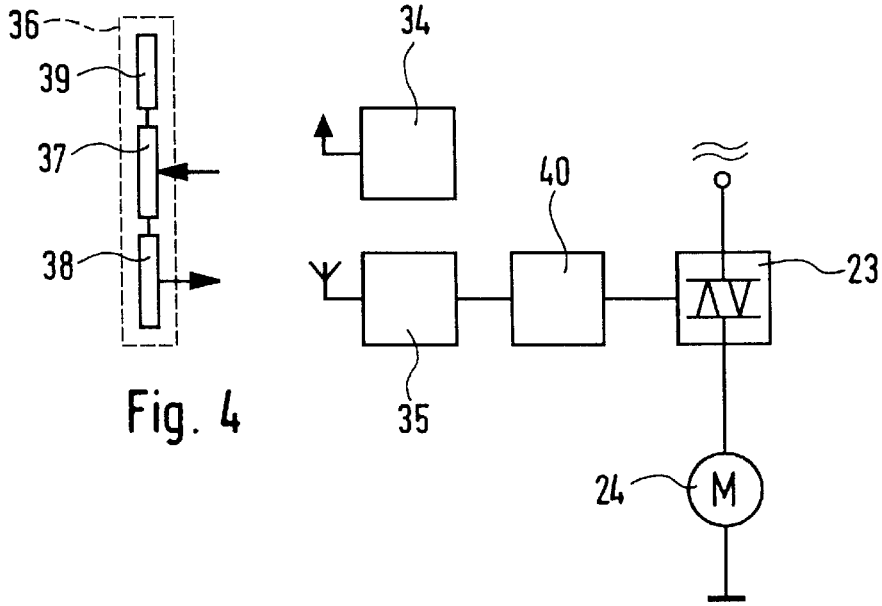
FIG. 4 is a block circuit diagram of a second embodiment in accordance with the invention in the case of which the detectable element is adapted to retransmit the received electromagnetic waves in a modified form.

On part of the connection means 11 metal foil is applied as a detectable element 18. Instead of metal foil it is also possible to provide a metal plate or a metallized area. On the side of the wall 12 which is opposite as regards the connection member 11, a printed circuit board 19 is arranged adjacent to the detectable element 18, such printed circuit board bearing an electronic circuit for detection of the detectable element 18 as is described and is illustrated in FIGS. 2 and 4 as an example. In the case of a multiple ply design of the connection member 11 the detectable element 18 may also be arranged between the plies, i. e. in the interior of the connection member 11 and is on the one hand protected and on the other hand arranged so that it may be seen from the outside.

In the case of the embodiment of the invention represented as a block circuit diagram in FIG. 2 an oscillating arrangement 20, adapted to transmit electromagnetic waves, is connected via a rectifier arrangement 21 with a comparator arrangement 22, via which a triac 23 in the circuit of a vacuum cleaner motor 24 may be controlled.

ACCOUNT OF MANNER OF WORKING

The manner of operation is such that the oscillating circuit, excited via an excite switch, not illustrated, of the oscillating arrangement 20 transmits electromagnetic waves. The AC signals produced in the electronic circuit owing to the oscillations are rectified in the rectifier arrangement 21 so that a signal appears at the output thereof which is dependent on the amplitude of the oscillations. In the comparators arrangement 22 comprising two comparators a check is made to determine whether such signal is smaller than its first threshold value $S_1$ and simultaneously larger than a second, lower threshold value $S_2$. It is only when these two conditions are fulfilled that the triac 23 is turned on so that the vacuum cleaner motor 24 may be turned on by means of a manual 49. The first threshold value $S_1$ is in this respect so set that the output signal in the rectifier arrangement 21 is higher during undamped operation of the oscillating circuit arrangement so that the triac 23 is turned off.

If now the filter bag as depicted in FIG. 1 is mounted in the vacuum cleaner 44 in the proper fashion the detectable element 18 will come within the range of action of the oscillating circuit arrangement 20 and owing to the voltage induced in the detectable element 18 eddy currents will be produced, which will sample energy from the oscillating circuit and damp the same. Accordingly the amplitude of oscillation will be reduced so that the output signal of the rectifier arrangement 21 goes down. The two threshold values $S_1$ and $S_2$ are so set that the attenuation or damping caused by the detectable element 18 in the correctly mounted condition of the connection member 11 is just sufficient to force the output signal of the rectifier arrangement 21 under the top threshold value $S_1$ but not however below the bottom threshold value $S_2$ so that the condition stipulated is complied with and the triac 23 is turned on so that the vacuum cleaner motor 24 can be turned on or, respectively, operated. In the case of the wrong type of connection member 11 without a detectable element 18 or, respectively, with a detectable element with a smaller area, the threshold value $S_1$ would not be gone below and the vacuum cleaner could not be operated. If on the contrary the wrong type of connection member were to be employed having an excessively large detectable element the consequence of the greater attenuation would again be that the threshold value $S_2$ would be gone below and the vacuum cleaner could again not be operated. It is only a filter bag with a connection member 11 fitted with the correct detectable element 18 which permits operation of the vacuum cleaner 44.

In a simpler embodiment the comparator arrangement 22 might have only one comparator so that a check would merely be carried out as to whether a detectable element 18 with a certain minimum size is comprised in or on the connection member 11. In lieu of a triac 23 it is also possible to employ some other known electric or electronic switch.

Figure 3:
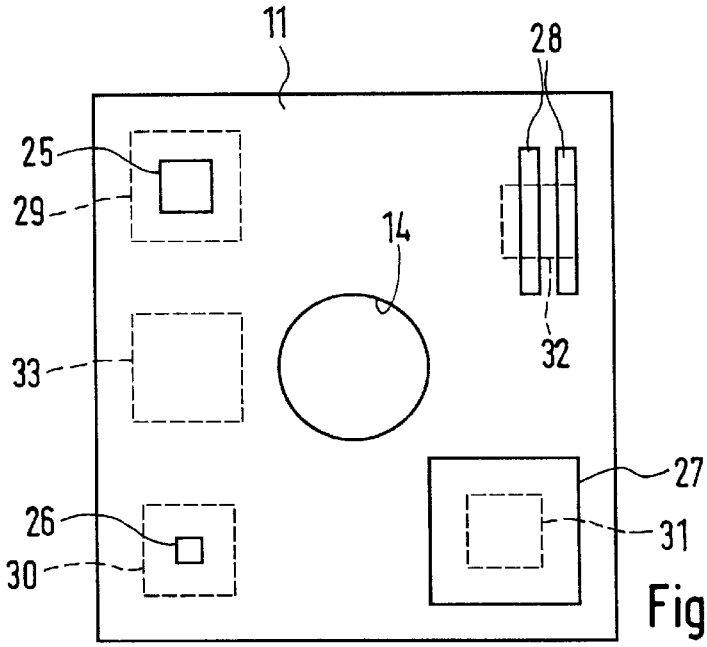
FIG. 3 shows an arrangement of various different detectable elements on a connection member of a filter bag in plan view.

In FIG. 3 the connection member 11 is represented in a diagrammatic plan view. In order to render possible an even more precise discrimination of the correct filter bag 10 or, respectively, correct connection member 11, on or in such connection member 11 four different detectable elements 25 through 28 are arranged on or in the connection member 11: three detectable elements 25 through 27 with a rectangular shape and one detectable element 28 in the form of a twin strip. Opposite to these detectable elements 25 through 28 in a suitable arrangement—assuming a correct insertion of the connection member 11—there are four oscillating circuit arrangements carried on the printed circuit board 19 represented by phantom blocks 29, 30, 31 and 32, which sense or check the respective detectable elements 25 through 28. A fifth oscillating circuit) arrangement represented by phantom block 33, is not opposite to any detectable element. Each of the oscillating circuit arrangements 29 through 33 is accordingly damped in a certain manner, the oscillating circuit arrangement 33 not being subjected to any damping. This is checked in comparator arrangements (not illustrated) and it is only if the stipulated damping level is detected all over that the triac 23 is turned on. The number and arrangement of the detectable elements and oscillating circuit arrangements may naturally selected in practically any manner desired.

In the case of the circuit depicted in FIG. 4 as a further embodiment for checking a correct filter bag or, respectively, connection member there is a sensor device comprising a transmitter 34 and a receiver 35 for electromagnetic waves. A detectable element 36 to be arranged on the connection member 11 is designed in the form of micro-chip and also comprises a receiver 37 and an electromagnetic wave transmitter 38. In addition a power supply device 39 for the receiver 37 and the transmitter 38 is provided, which is either designed in the form of a battery or is connected with the oscillating circuit of the receiver 37 and obtains the power supply voltage from the RF energy received in the oscillating circuit, as is disclosed for instance in the German patent 4,110,683.

In the receiver 37 or in the transmitter 38 a converter is comprised, by which the received signal is modified. This modified signal is then fed back by the transmitter 38 of the detectable element 36 to the receiver 35 of the sensor device. Conversion may for example be implemented by modifying the frequency or phase angle of the RF signal. As an alternative to this it is also possible for the retransmitted signal to be modulated in a predetermined manner so that a certain code is transmitted to the receiver 35 of the sensor device. The signal received in the receiver 35 is then checked in a decoder 40 to determine whether the stipulated information of the detectable element 36 is in fact contained. If this is the case, the decoder 40 will put the triac 23 in the turned on state. Further possibilities for signal encoding and return transmission by detectable elements 36 designed in the form of micro-chips are disclosed in the said German patent 4,110,683.

An alternative possibility is such that the transmitter for electromagnetic waves is an optical transmitter and the receiver for electromagnetic waves is in the form of an optical receiver. As a detectable element it is then possible to employ a bar-code or another device, which retransmit the light in a modified or non-modified way back to the optical or light receiver of the sensor device. For instance as a deflection element in the detectable element a light guide may be utilized, which returns the light received at one point by the sensor device at another point to the connection member, on which the optical receiver is arranged.

A further alternative possibility is capacitive detection of the detectable element. In this case the detectable element is again a current conducting plate or, respectively, metallic sheet element, which constitutes a part of a capacitive measuring oscillating circuit.

The circuits represented in FIGS. 2 and 4 as embodiments and which comprise sensor devices and processing devices, may be included on the printed circuit board 19 as integrated or non-integrated circuits. In this respect it is for example also possible for the entire circuit to be designed completely or partially in the form of an integrated circuit.

As a modification of the embodiments illustrated it is also possible to arrange a detectable element or a plurality of detectable elements on the filter bag 10 as such, which in operation generally is in contact with the inner wall surface of a filter bag receiving 45 space in the vacuum cleaner 44. On such wall surfaces it is then possible for the printed circuit board 19 and/or an integrated sensor and processing circuit to be arranged. Combined designs are possible as well, in the case of which some detectable elements are arranged on the filter bag 10 proper and some on the connection member.

I claim:

1. A detector assembly for sensing if a filter bag has been attached to a vacuum cleaner, the vacuum cleaner having a motor, said detector assembly comprising:

a sensor configured to detect the presence of a filter bag by transmitting electromagnetic waves to determine the presence of a detectable element integral with the filter bag and that produces a sensor output signal that varies based on the presence, type and position of the filter bag detectable element;

a processing circuit for receiving the sensor output signal, said processing circuit configured to evaluate the sensor output signal to determine if the sensor output signal indicates said sensor has detected the presence of a select type of filter bag detectable element in a select position and, if the detection occurs, to assert a switch-on signal; and a switch for receiving the switch-on signal from the processing circuit, said switch being connected to the vacuum cleaner motor for regulating actuation of the vacuum cleaner motor, wherein said switch prevents actuation of the vacuum cleaner motor unless the switch-on signal is received.

2. The detector assembly of claim 1, wherein said sensor and said processing circuit are mounted on a single printed circuit board.

3. The detector assembly of claim 2, wherein said switch is mounted on said printed circuit board.

4. The detector assembly of claim 1, wherein said sensor and said processing circuit are formed as an integrated circuit.

5. The detector assembly of claim 4, wherein said switch is formed as part of said integrated circuit.

6. The detector assembly of claim 1, wherein said sensor includes an oscillating circuit for transmitting the electromagnetic waves.

7. The detector assembly of claim 1, wherein the detectable element is a metallic plate and said sensor is configured to produce the sensor output signal as a function of eddy current effect-induced damping of the electromagnetic waves by said metallic plate.

8. The detector assembly of claim 7, wherein said sensor produces a variable amplitude oscillating sensor output signal and said processing circuit is configured to compare the sensor output signal to a reference signal to determine if a select filter bag detectable element is present in a select position.

9. The detector assembly of claim 8, wherein said processing circuit includes:

a signal converter circuit for receiving the sensor output signal that produces a variable signal as a function of the amplitude of the oscillations of the sensor output signal; and a comparator assembly to which the variable signal is applied, said comparator assembly being configured to compare the variable signal to a first reference signal and, if the variable signal is equal to or less than the first reference signal, to assert the switch-on signal.

10. The detector assembly of claim 9, wherein said comparator assembly is configured to compare the variable signal to a second reference signal that is less than the first reference signal while comparing the variable signal to the first reference signal and, if the variable signal is between the first and second reference signals, to assert the switch-on signal.

11. The detector assembly of claim 9 wherein the variable signal produced by said signal converter is a variable voltage DC signal.

12. The detector assembly of claim 1, wherein said sensor includes a transmitter configured to broadcast electromagnetic waves to the detectable element and a receiver configured to receive electromagnetic waves transmitted by the filter bag detectable element in response to the broadcast by said sensor transmitter.

13. The detector assembly of claim 12, wherein said sensor transmitter broadcasts an RF signal, the filter bag detectable element produces a detectable element output signal in which the frequency or phase of the RF signal broadcast by the sensor transmitter is modified and said sensor receiver, based on the signal received from the detectable element, produces the sensor output signal.

14. The detector assembly of claim 12, wherein the filter bag detectable element, upon receiving the electromagnet waves from said sensor transmitter, produces a detectable element output signal in which a code is embedded and said sensor receiver is configured to receive the detectable element output signal and to produce the sensor output signal in which the code from the detectable element output signal is embedded in the sensor output signal.

15. The detector assembly of claim 14, wherein said processing circuit is configured to read the sensor output signal to determine the code embedded in the sensor output signal and to assert the switch-on signal as a function of the code read from the sensor output signal.

16. The detector assembly of claim 1, wherein said sensor is configured to capacitively determine the presence, type and position of the detectable element.

17. The detector assembly of claim 1, further including a plurality of separate said sensors, said sensors collectively configured to determine the presence, type and location of different filter bag detectable elements and wherein said processing circuit is configured to receive the sensor output signals produced by said sensors and, if said sensor output signals indicate that said sensors have detected the presence of select detectable elements in select positions, to assert the switch-on signal.

18. A vacuum cleaner comprising:

a housing having a space for removably receiving a filter bag, said housing having a wall;

a connection spout mounted to said wall of said housing for coupling into an open end of the filter bag;

a motor which is selectively energized to cause air flow through said connection spout into the filter bag; and a detector assembly for sensing if the filter bag is properly mounted in the housing, said detector assembly including:

a sensor configured to detect the presence of the filter bag by transmitting electromagnetic waves to determine the presence of a detectable element integral with the filter bag and that produces a sensor output signal that varies based on the presence, type and position of the filter bag detectable element;

a processing circuit for receiving the sensor output signal, said processing circuit configured to evaluate the sensor output signal to determine if the sensor output signal indicates said sensor has detected the presence of a select type of filter bag detectable element in a select position and, if the detection occurs, to assert a switch-on signal; and a switch for receiving the switch-on signal from said processing circuit and that is connected to said motor for regulating actuation of said motor, wherein said switch prevents actuation of said motor unless the switch-on signal is received.

19. The vacuum cleaner of claim 18, wherein said sensor is mounted to said wall of said housing to which said connection spout is attached.

20. The vacuum cleaner of claim 19, wherein said sensor is mounted to a side of said wall opposite a side of said wall that faces the space for receiving the filter bag.

21. The vacuum cleaner of claim 18, wherein said detector assembly sensor includes an oscillating circuit for transmitting the electromagnetic waves.

22. The vacuum cleaner of claim 18, wherein the filter bag detectable element is a metallic plate and said detector assembly sensor is configured to produce the sensor output signal as a function of eddy current effect-induced damping of the electromagnetic waves by said metallic plate.

23. The vacuum cleaner of claim 18, wherein said detector assembly sensor produces a variable amplitude oscillating sensor output signal and said processing circuit is configured to compare the sensor output signal to a reference signal to determine if a select filter bag detectable element is present in a select position.

24. The vacuum cleaner of claim 18, wherein said detector assembly sensor includes a transmitter configured to broadcast electromagnetic waves to the detectable element and a receiver configured to receive electromagnetic waves transmitted by the filter bag detectable element in response to the broadcast by said sensor transmitter.

25. The vacuum cleaner of claim 24, wherein said sensor transmitter broadcasts an RF signal, the filter bag detectable element produces a detectable element output signal in which the frequency or phase of the RF signal broadcast by said sensor transmitter is modified and said sensor receiver, based on the signal received from the detectable element, produces the sensor output signal.

26. The vacuum cleaner of claim 24, wherein the filter bag detectable element, upon receiving the electromagnet waves from said sensor transmitter, produces a detectable element output signal in which a code is embedded, said sensor receiver is configured to receive the detectable element output signal and to produce the sensor output signal so that the code from the detectable element output signal is embedded in the sensor output signal.

27. The vacuum cleaner of claim 18, wherein said detector assembly sensor is configured to capacitively determine the presence, type and position of the filter bag detectable element.

28. The vacuum cleaner of claim 18, wherein said detector assembly includes a plurality of separate said sensors, said sensors collectively configured to determine the presence, type and location of different filter bag detectable elements and wherein said processing circuit is configured to receive the sensor output signals produced by said sensors and, if said sensor output signals indicate that said sensors have detected the presence of select detectable elements in select positions, to assert the switch-on signal.

29. A vacuum cleaner comprising:

a housing having a space for removably receiving a filter bag, said housing having a wall;

a connection spout mounted to said wall of said housing for coupling into an open end of the filter bag;

a motor which is selectively energized to cause air flow through said connection spout into the filter bag; and a detector assembly for sensing if the filter bag is properly mounted in the housing, said detector assembly including:

a sensor mounted to said wall of said housing, said sensor configured to detect the presence of the filter bag by transmitting electromagnetic waves to determine the presence of a detectable element integral with the filter bag and that produces a sensor output signal that varies based on the presence, type and position of the filter bag detectable element;

a processing circuit for receiving the sensor output signal, said processing circuit configured to compare the sensor output signal to a reference signal to determine if the sensor output signal indicates said sensor has detected the presence of a select type of filter bag detectable element in a select position and, if the detection occurs, to assert a switch-on signal; and a switch for receiving the switch-on signal from said processing circuit and that is connected to said motor for regulating actuation of said motor, wherein said switch prevents actuation of said motor unless the switch-on signal is received.

30. The vacuum cleaner of claim 29, wherein said detector assembly sensor is configured to capacitively determine the presence, type and position of the detectable element.

31. The vacuum cleaner of claim 29, wherein:

said detector assembly includes a plurality of said sensors, wherein said sensors produce sensor output signals based on the presence, type and locations of plural detectable elements integral with the filter bag; and said processing circuit is configured to receive the sensor output signals produced by said sensors and to compare the sensor output signals to reference signals, and if the comparisons indicate the presence of select detectable elements in select locations, to assert the switch-on signal.

32. The vacuum cleaner of claim 29, wherein: said detector assembly sensor and said processing circuit are mounted to a single printed circuit board; and said printed circuit board is mounted to a side of said wall of said housing opposite a side of said wall that faces the space for receiving the filter bag.

33. A vacuum cleaner comprising:

a housing having a space for removably receiving a filter bag, said housing having a wall;

a connection spout mounted to said wall of said housing for coupling into an open end of the filter bag;

a motor which is selectively energized to cause air flow through said connection spout into the filter bag; and a detector assembly for sensing if the filter bag is properly mounted in the housing, said detector assembly including:

a transmitter mounted to said wall of said housing, said transmitter configured to broadcast an RF signal;

a receiver mounted to said wall of said housing, said receiver configured to receive electromagnetic waves broadcast by a filter bag detectable element in response to the RF signal broadcast by said transmitter, wherein the electromagnetic waves broadcast by the detectable element vary based on the presence, type and position of the detectable element and the receiver generates an output signal based on the received electromagnetic waves;

a processing circuit for receiving the receiver output signal, said processing circuit configured to evaluate the receiver output signal to determine if the receiver output signal indicates the presence of a select type of filter bag detectable element in a select position relative to said receiver and, if the detection occurs, to assert a switch-on signal; and a switch for receiving the switch-on signal from said processing circuit and that is connected to said motor for regulating actuation of said motor, wherein said switch prevents actuation of said motor unless the switch-on signal is received.

34. The vacuum cleaner of detector assembly of claim 33, wherein:

said detector assembly receiver is configured to receive from the filter bag detectable element electromagnetic waves in which a code is embedded and to embed the code in the receiver output signal; and said detector assembly processing circuit is configured to read the receiver output signal to determine the code embedded in the receiver output signal and to assert the switch-on signal as a function of the code read from the receiver output signal.

* * * * *